US005195937A

United States Patent [19]

Engel et al.

[11] Patent Number: 5,195,937

[45] Date of Patent: Mar. 23, 1993

[54] MULTI-EXERCISE APPARATUS

[75] Inventors: Timothy S. Engel, Mound; Frank W. Campbell, Robbinsdale; Stephen S. Peterson, Maple Grove; Craig A. Loubert, Minneapolis; Edward R. Holden, Prior Lake, all of Minn.

[73] Assignee: NordicTrack, Inc., Chaska, Minn.

[21] Appl. No.: 791,073

[22] Filed: Nov. 12, 1991

Related U.S. Application Data

[63] Continuation-in-part of Ser. No. 500,517, Mar. 28, 1990, Pat. No. 5,090,694.

[51] Int. Cl.[5] ..... A63B 21/015

[52] U.S. Cl. ..... 482/119; 482/8; 482/116; 482/133; 482/135; 482/137; 482/138

[58] Field of Search ..... 482/8-9, 482/94, 98-103, 114-119, 133, 135-138, 142, 148

[56] References Cited

U.S. PATENT DOCUMENTS

| | | | |
|---|---|---|---|
| 3,501,143 | 3/1970 | Glierin | 272/142 |
| 3,638,941 | 2/1972 | Kulkens | 272/142 X |
| 3,647,209 | 3/1972 | LaLanne | 272/144 X |
| 3,662,602 | 5/1972 | Weiss | 272/142 X |
| 3,861,215 | 1/1975 | Bradley | 482/116 |
| 3,982,757 | 9/1976 | McDonnell | 272/136 X |
| 3,989,241 | 11/1976 | Ourgant | 272/142 X |
| 4,072,309 | 2/1978 | Wilson | 482/130 |
| 4,346,888 | 8/1982 | Szabo | 482/101 |
| 4,492,375 | 1/1985 | Connelly | 482/138 |
| 4,493,485 | 1/1985 | Jones | 482/8 |
| 4,582,320 | 4/1986 | Shaw | 482/130 |
| 4,624,457 | 11/1986 | Silberman et al. | 482/99 X |
| 4,634,127 | 1/1987 | Rockwell | 482/138 |
| 4,643,420 | 2/1987 | Rilley et al. | 482/130 |
| 4,667,955 | 5/1987 | Giesch | 482/138 X |
| 4,721,301 | 1/1988 | Drake | 482/102 |
| 4,765,613 | 8/1988 | Voris | 482/8 X |
| 4,778,175 | 10/1988 | Wucherpfennig et al. | 482/8 X |
| 4,793,608 | 12/1988 | Mahnke et al. | 482/138 X |
| 4,809,972 | 3/1989 | Rasmussen et al. | 482/138 X |
| 4,826,154 | 5/1989 | Askonen | 482/101 |
| 4,911,436 | 3/1990 | Lighter | 482/138 X |
| 5,085,430 | 2/1992 | Habing | 482/138 X |

FOREIGN PATENT DOCUMENTS

| | | | |
|---|---|---|---|
| 3326426 | 1/1985 | Fed. Rep. of Germany | 482/101 |
| 8005681 | 5/1982 | Netherlands | 482/138 |

*Primary Examiner*—Robert Bahr

*Attorney, Agent, or Firm*—Merchant, Gould, Edell, Welter & Schmidt

[57] ABSTRACT

A multiple exercise unit capable of providing a user with a wide range of strength and conditioning exercises. The exercise unit provides resistance through an isokinetic device which utilizes a clutch mechanism. Lines extend out of the isokinetic device and attach to various exercise elements such that a variety of upper and lower body strength exercises may be performed.

21 Claims, 12 Drawing Sheets

MULTI-EXERCISE APPARATUS

This is a continuation-in-part of U.S. patent application Ser. No. 07/500,517, filed Mar. 28, 1990, now U.S. Pat. No. 5,090,694.

FIELD OF THE INVENTION

The present invention relates to a multi exercise unit which encompasses both upper and lower body training exercises. The unit is designed for home use and provides a wide array of different exercises. The unit has a resistance mechanism which provides resistance for upper and lower body exercises.

BACKGROUND OF THE INVENTION

The prior art shows various types of exercising devices that use cables, pulleys, elastic mechanisms, free weights and other loading devices. The devices may be used for bench presses, lat pulls, butterfly reps, arm and leg curls, squats, leg extensions as well as other exercises.

U.S. Pat. No. Re. 4,072,309 discloses a multi-purpose exercise device. The device provides for a variety of exercises using spring means such as shock cords to provide resistance. As the user moves a lever arm, the spring means resists the movement. However, this device has the drawback of an uneven force applied throughout the stroke. The uneven force results from the mechanics of a spring which applies little resistive force when stretched a short way, but applies an extremely high resistive force when stretched close to its maximum. Furthermore, these types of resistance devices can also be unsafe in that if the user loss his/her grip, the lever arm snaps quickly back into place, possibly injuring the user. Another disadvantage of this exercise unit is the angular displacement that the bench press/squat bar travels during the stroke. The pivot point of the bar is on the vertical member. As the bar is moved upward, it reduces the resultant angle between the bar and the vertical member, until at its maximum the bar touches the vertical member. This is not the desirable travel path a bar moves in a bench press or squat exercise.

Other exercise devices utilize free weights which are lifted with cables. Examples of this technology include U.S. Pat No. 4,678,185. However, these devices often result in injuries on the eccentric or down stroke of the lever arm. This is due to the fact that most weight lifting injuries occur after the user has forced the resistance mechanism to a maximum. The user is lowering the resistive force by returning the lever or pivot arm to its resting position and injuries tend to occur during this motion. Thus, it is preferred not to have any resistance on this eccentric portion of the exercise repetition.

Other resistance devices include isotonic devices which utilize a cam in conjunction with a stack of weights. The cam is shaped such that a chain around the cam gives the user a mechanical advantage during the portion of the stroke which the "typical" user is weakest. However, all users are not built the same, and the cam cannot possibly be designed for everyone. Thus, it would be desirable to have a resistance device which provides a resistance which reacts to the user, not built for a "typical" user.

None of these prior art devices show an apparatus which can provide a whole host of weight lifting exercises, yet provide the resistance in a safe, uniform manner. Furthermore, there is no disclosure of a resistance mechanism which responds to the user.

MGI Strength Fitness, Inc. makes and sells an isokinetic exerciser called the MINI-GYM, which has pull ropes that load in proportion to the amount of force being applied. The device can be either wall or floor mounted, or mounted on fixed frames for providing the resistance force for exercise. The devices are gymnasium type devices, and have the appearance of conventional exercisers. Flexible lines or ropes are used in various frame assemblies for these isokinetic exercisers. However, the MINI-GYM does not provide for a variety of upper and lower body exercises as necessary for a complete home unit.

The present invention provides the ability to do pullovers, pull downs, chest crosses, butterflies (with the arms either up or down), chest presses, bicep curls, leg curls, leg extensions, squats, etc. Thus, the present invention permits a wide range of exercises for complete conditioning in a safe and user friendly exercise apparatus.

BRIEF DESCRIPTION OF THE INVENTION

The present invention provides a novel home exercise unit which has a wide range of upper and lower body conditioning exercises. The exercise unit has a resistance mechanism which is safe, provides a constant resistive force, and is responsive to the user. The exercise apparatus comprises:

(a) a positionable bench;

(b) a horizontal member extending below the bench;

(c) a vertical member extending upwardly from a first end of the horizontal member;

(d) a loading device operable to apply a drag on a moveable element forming part of the loading device, the loading device situated on said horizontal member or vertical member, the loading device comprising a rotatable centrifugal force sensitive force generating brake member that provides a resistive force proportional to the speed of rotation of the rotatable member; and (e) an exercise operable element connected to the loading device by a flexible line means, the line means being mounted such that upon movement of the line means away from the loading device, the moveable element of the loading device is moved and the line means is loaded.

The loading device is an isokinetic device which is positioned below the bench, and is of a small enough size so that it does not protrude excessively out of either side. It is an isokinetic exercise unit in that the resistive force increases to match the applied force or speed. The unit provides a safe form of exercise since there are no weights that will fall or cause a strain on muscles, no elastic cords or gaskets which snap back and the resistance force will stop as soon as the applied force is stopped. In this manner, an individual may exercise without fear of injury and may stop the exercise in mid-stroke. As muscles are fatigued during the exercise, the exercise regime can continue at a slower pace and the loads will automatically be reduced.

DESCRIPTION OF THE PREFERRED EMBODIMENTS

The exercise apparatus comprises a loading or force generating assembly which will generate isokinetic resistive forces for loading muscles that are being used to move (extend) cords or lines. The exercise apparatus is made so that the direction of force to be applied by the person performing the exercise can be changed to exercise different muscles and to provide force directions that are selected for an overall upper and lower body exercise program.

In order to serve as a functioning exerciser, the isokinetic device has to be capable of providing resistive forces that are adequate for a wide range of loads, accommodate a number of different levels of exercise and also permit the user to vary the forces across a range of exercises from a warm-up period to a full load period.

Figure 1:
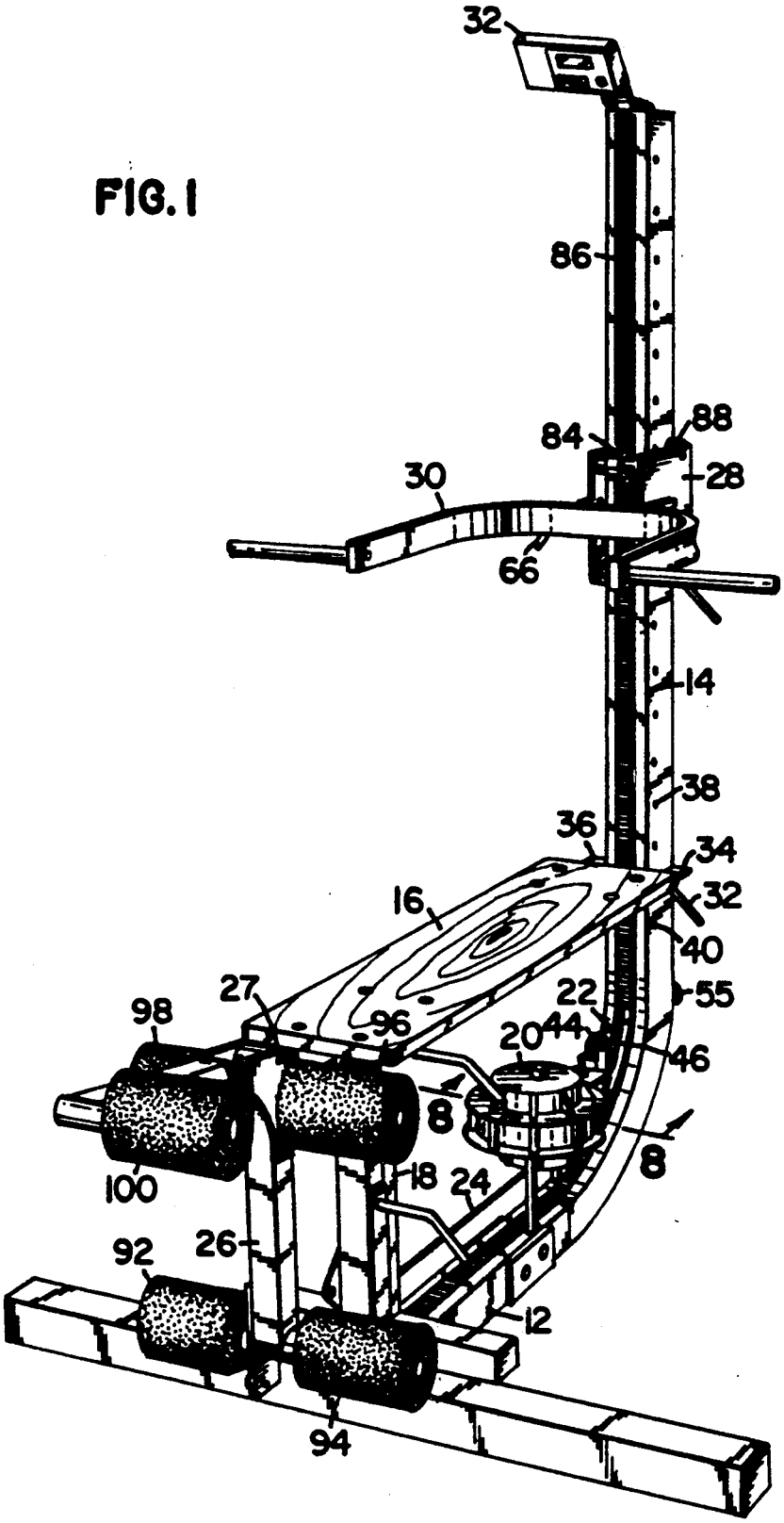
FIG. 1 is a perspective view of the multi exercise unit according to the present invention.

Referring to FIG. 1, the exercise unit of the present invention is shown as 10. The exercise unit has a horizontal T-member 12 and a vertical member 14. The shape of the horizontal member 12 may be a T as shown or could also be a Y or other configuration which would provide a stable base. Furthermore, the horizontal member 12 and the vertical member 14 are shown as one piece. However, this could be a two piece configuration. Bench 16 is shown attached to vertical member 14, and resting on support member 18. Support member 18 extends from horizontal member 12 and may or may not be removable from horizontal member 12. The isokinetic device 20 is shown secured to the horizontal member 12 with lines or cords 22 and 24 extending therefrom. Cord 24 extends away from the vertical member and is attached to L-shaped exercise element 26, which pivots about point 27. This exercise element 26 is generally used for lower body conditioning such as leg extensions and leg curls. Pads 92, 94, 96, 98 and 100 are for the user's comfort during exercise. The L-shaped exercise element 26 may or may not be attached to the exercise apparatus 10. It may be removed when it is not in use. Cord 22 extends through vertical member 14 and upward on the vertical member 14 as shown in FIGS. 5-7. Line 22 is attached to carriage 28. The carriage 28 travels up and down vertical member 14 and is shown in more detail in FIGS. 4 and 10. The carriage 28 can be any type of sliding configuration which allows the transfer of resistance from the isokinetic device 20 to exercise element. Bench press exercise element 30 is shown attached to carriage 28. This exercise element 30 may be used for bench presses or may also be used for squats, with the bench 16 removed. Electronic display readout 32 provides the user with a multitude of readouts including number of repetitions, the measured force, the maximum force exerted, as well as other useful information.

Figure 2:
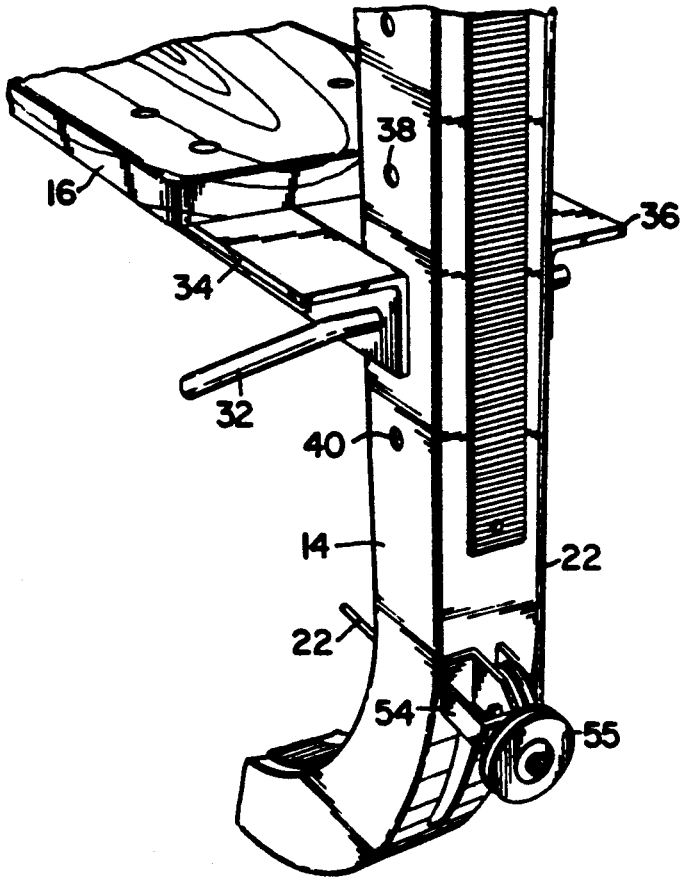
FIG. 2 is a perspective view of a portion of the rear of the multi exercise unit of FIG. 1.
Figure 3:
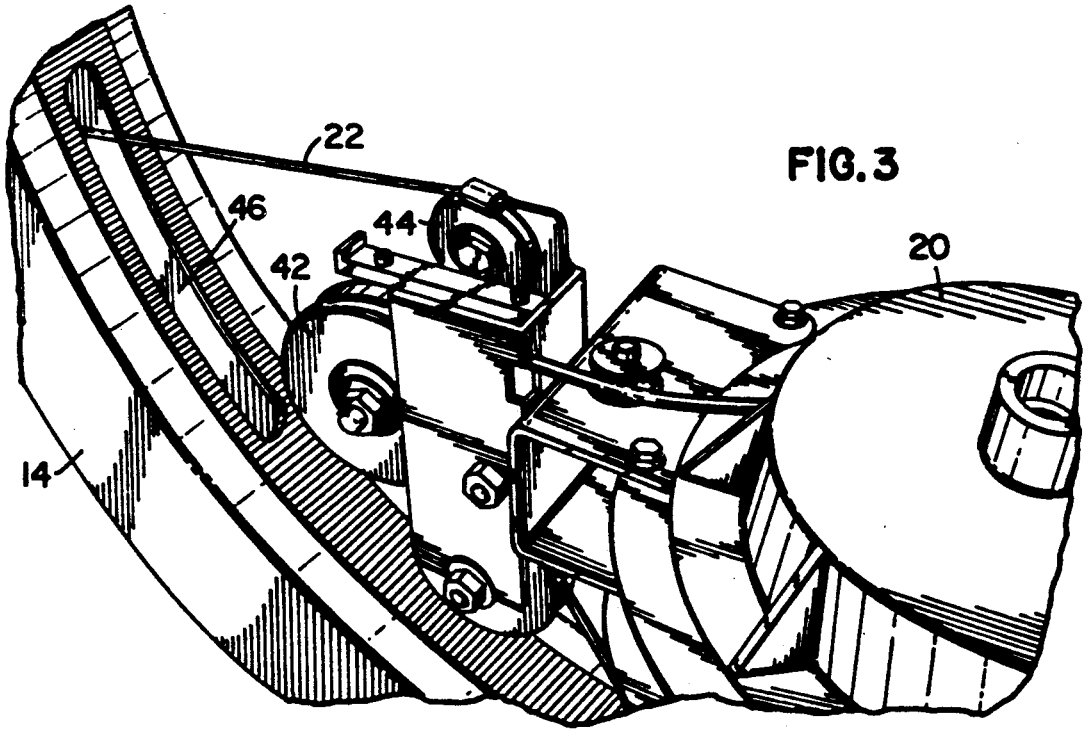
FIG. 3 is a perspective view of a portion of the isokinetic device of the multi exercise unit of FIG. 1.

FIGS. 2 and 3 show the isokinetic device 20 and the attachment of bench 16 in more detail. As is shown in FIG. 2, bench 16 is attached to vertical member 14 by pin 32 extending through brackets 34 and 36 which are attached to bench 16. The pin 32 extends through apertures in brackets 34 and 36 and apertures in the vertical member 14. It is also desirable to be able to change the elevation of the bench 16 for various exercises including sit-ups. To accommodate this, the bench 16 may be raised or lowered, with the pin 32 being inserted into apertures 38 or 40 respectively. In this manner, inverted sit-ups are possible.

Referring to FIG. 3, cord 22 extends out of loading device 20, through two circular pulleys 42 and 44 and extends through aperture 46 which is in vertical member 14. Cord 22 may also extend up vertical member 14 on the inside, but for aesthetic reasons as well as to move the cords out of the user's way, it is preferred to run the cords on the outside of vertical member 14.

Figure 4:
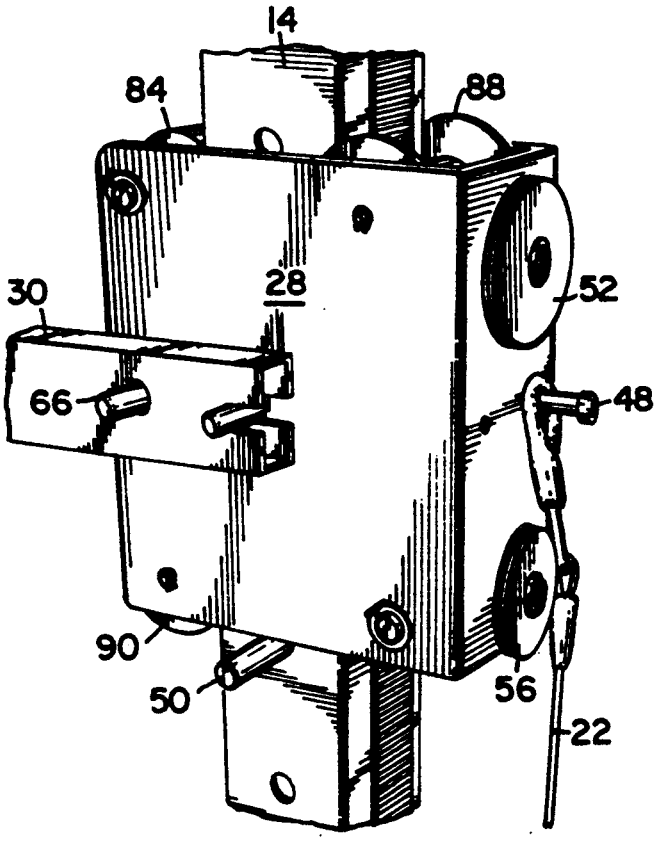
FIG. 4 is a perspective view of the carriage of the present invention.
Figure 5:
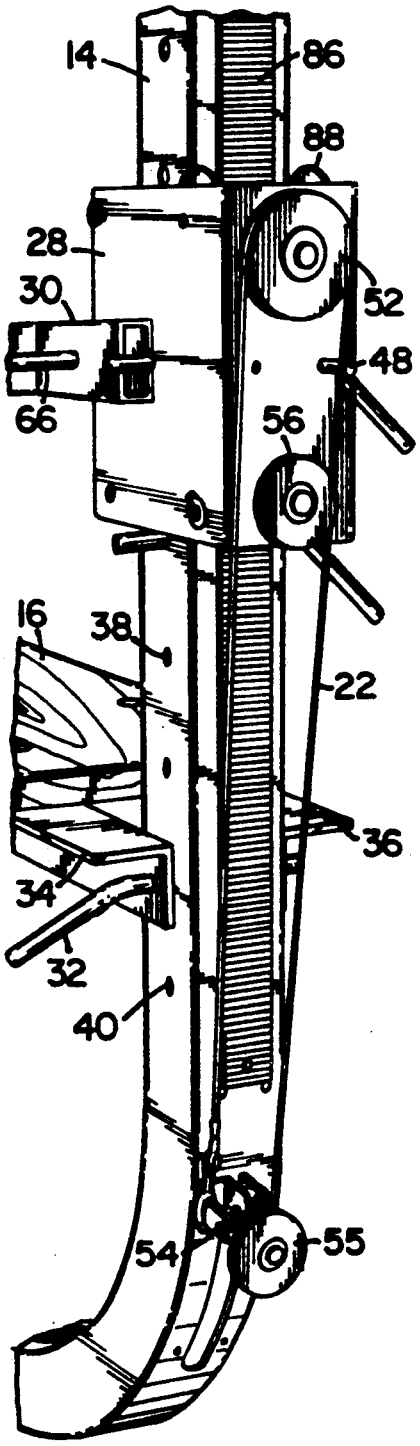
FIGS. 5, 6 and 7 are perspective views of different resistive settings for the isokinetic device of the present invention.
Figure 6:
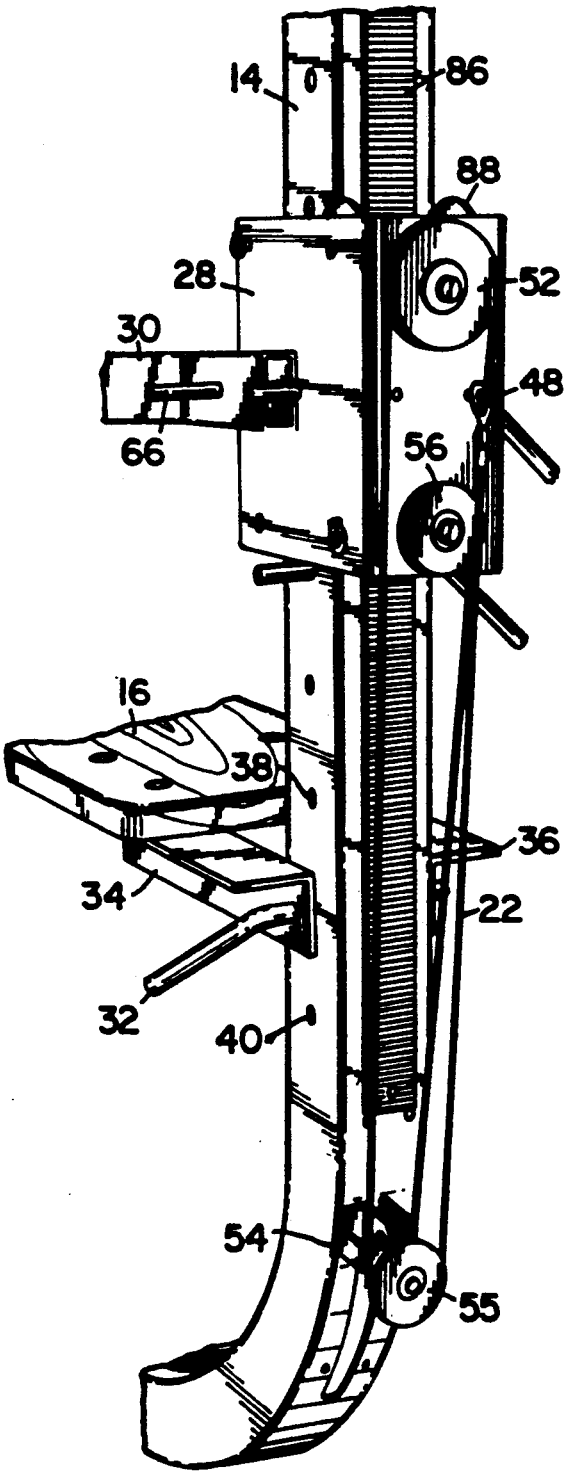
Figure 7:
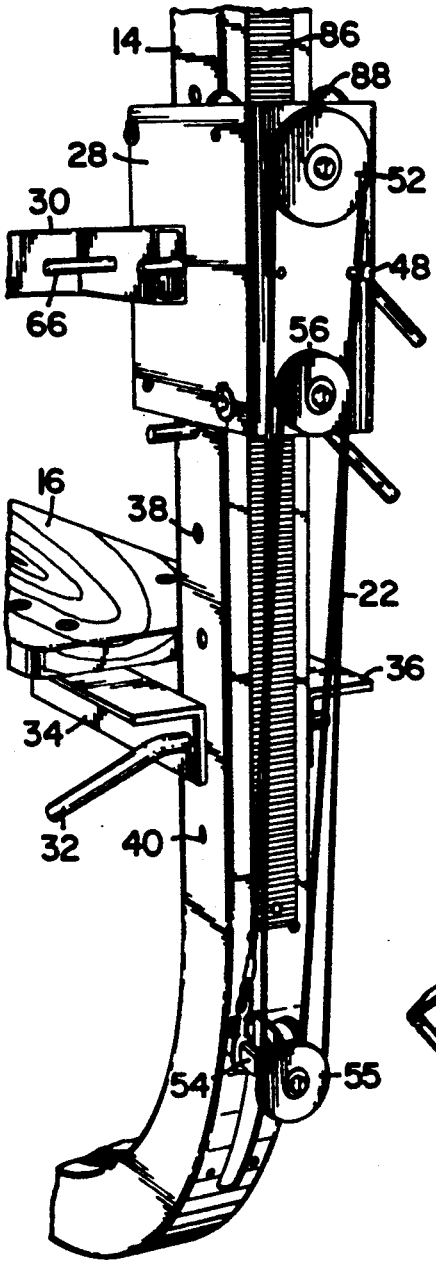

FIGS. 4, 5, 6, and 7 show cord 22 adjusted such that varying degrees of resistance are achieved. In the preferred embodiment of the present invention there are four resistance levels for exercises involving carriage 28. The resistance provided by isokinetic device 20 is a function of the speed of the line moving out of isokinetic device 20. This is further explained in FIGS. 14-17, wherein the resistance mechanism is described in detail. The preferred embodiment of the present invention has four levels of resistance for carriage 28. The first, shown at FIG. 4, is a low resistance. Line 22 is shown attached to pin 48. The carriage rests on pin 50. As the bench press element 30 is pushed in an upward direction, carriage 28 travels in a vertical plane on vertical member 14 which thus pulls line 22 out of isokinetic device 20. When the carriage 28 reaches its maximum height along vertical members 14, and when the down stroke begins, line 22 is recoiled into isokinetic device 20, with the only resistance at that time being the weight of carriage 28. Thus, the present exercise unit provides resistance for the concentric portion of the exercise, but provides little to no resistance on the eccentric portion of the exerciser (just the weight of the carriage), thereby reducing muscle injuries which often occur as a heavy load is being lowered during eccentric contractions. A further advantage over the prior art is that carriage 28 travels vertically along vertical member 14, thus during bench presses or squats, bar 30 also travels in a vertical motion. This feature is advantageous over other home exercise units which rely on a pivot point along the vertical member, and also rely on some sort of spring, shock cord or rubber gasket. In these prior art home devices, when a bar similar to bar 30 is moved in an upward direction, the bar not only moves upwardly but also moves closer to vertical member 14, thus resulting in an arcing motion. This is due to a pivot point located on or adjacent the vertical member. In the present invention, this arcing motion is avoided with the carriage 28 moving vertically up and down the vertical member 14. Thus, a fluid uni-directional stroke results, rather than the bar moving upward and angularly towards the vertical member. This upward and angular motion is undesirable for bench presses and squats in that when the individual exercising reaches maximum extension, it is very difficult motion for the exercising muscles to perform when they are being displaced in an angular motion. Thus, the present invention is desirable over the prior art for this feature as well as the other features outlined herein.

FIGS. 5, 6 and 7 show alternative levels of resistance corresponding to medium, heavy and professional resistance respectively. As is noted in FIG. 5, line 22 travels around pulley 52 and attaches to bracket 54. Thus, as carriage 28 travels up vertical member 14, line 22 extends outwardly at a speed approximately twice that of FIG. 4. This provides greater resistance.

FIG. 6, shows line 22 extending around pulley 52, around pulley 55 and secured to pin 48. This provides a higher degree of resistance than that shown in FIG. 5. As is obvious from the configuration, there is still further amount of line 22 being pulled out of isokinetic device 20 as carriage 28 travels up vertical member 14. The highest degree of the resistance of the preferred embodiment is shown at FIG. 7. Line 22 extends around pulley 52, pulley 55, pulley 56, and locks onto bracket 54. In this configuration, line 22 travels the fastest as it leaves isokinetic device 20. As is obvious from the configurations, there could be greater or fewer levels of resistance.

An advantage of the present invention's isokinetic device over the prior devices is the wide window of resistance which is provided with each level. Depending on the individual who uses the exercise apparatus, each of the four levels generally provides a wide enough window of resistance for all exercises. Thus, it should not be necessary to adjust to a different resistance level when, for example, switching from a bench press to a lat pull. This differs significantly from the prior art, which requires a different size shock cord or a different amount of weight for each exercise. Thus, the present invention allows the user to preset the resistance mechanism, and go through all of the exercises without the tedious and often confusing regime of switching shock cords, spring mechanisms, elastic bands, or weights for each different exercise.

Figure 10:
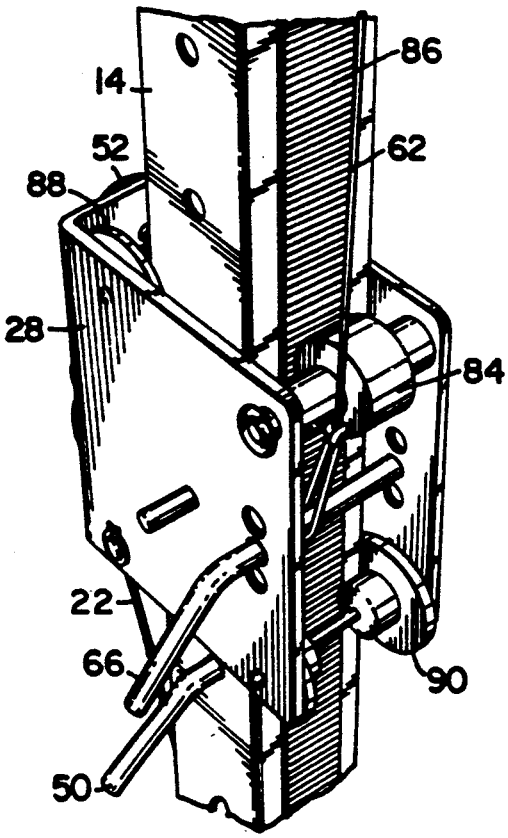
FIG. 10 is a perspective view of the carriage of the present invention.
Figure 8:
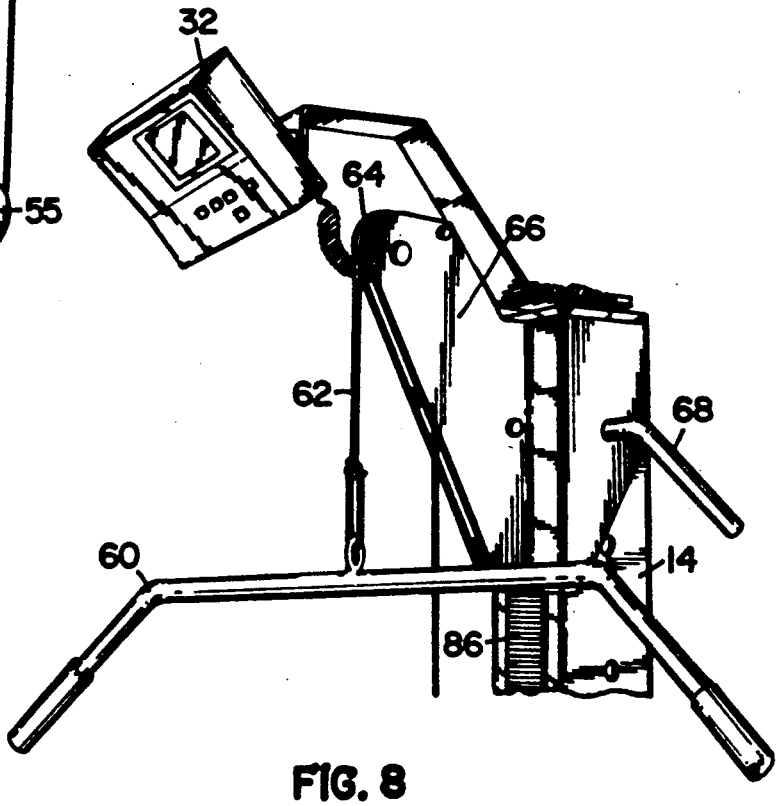
FIG. 8 is a perspective view of a lat pull attachment of the present invention.

FIG. 8 shows bar 60 which is connected to line 62 which extends over pulley 64 and down the back of vertical member 14 until line 62 attaches to pin 68 as shown in FIG. 10. Bar 60 is generally configured for lat pulls. The user sits on bench 16, grasps bar 60 and pulls it in a downward fashion. Line 62, being attached to carriage 28, lifts carriage 28 as bar 60 is pulled downward. The resistance of carriage 28 is set as described above. When not using exercises involving bar 60, bracket 66 may be removed from vertical member 14 by removing pin 68.

Figure 18:
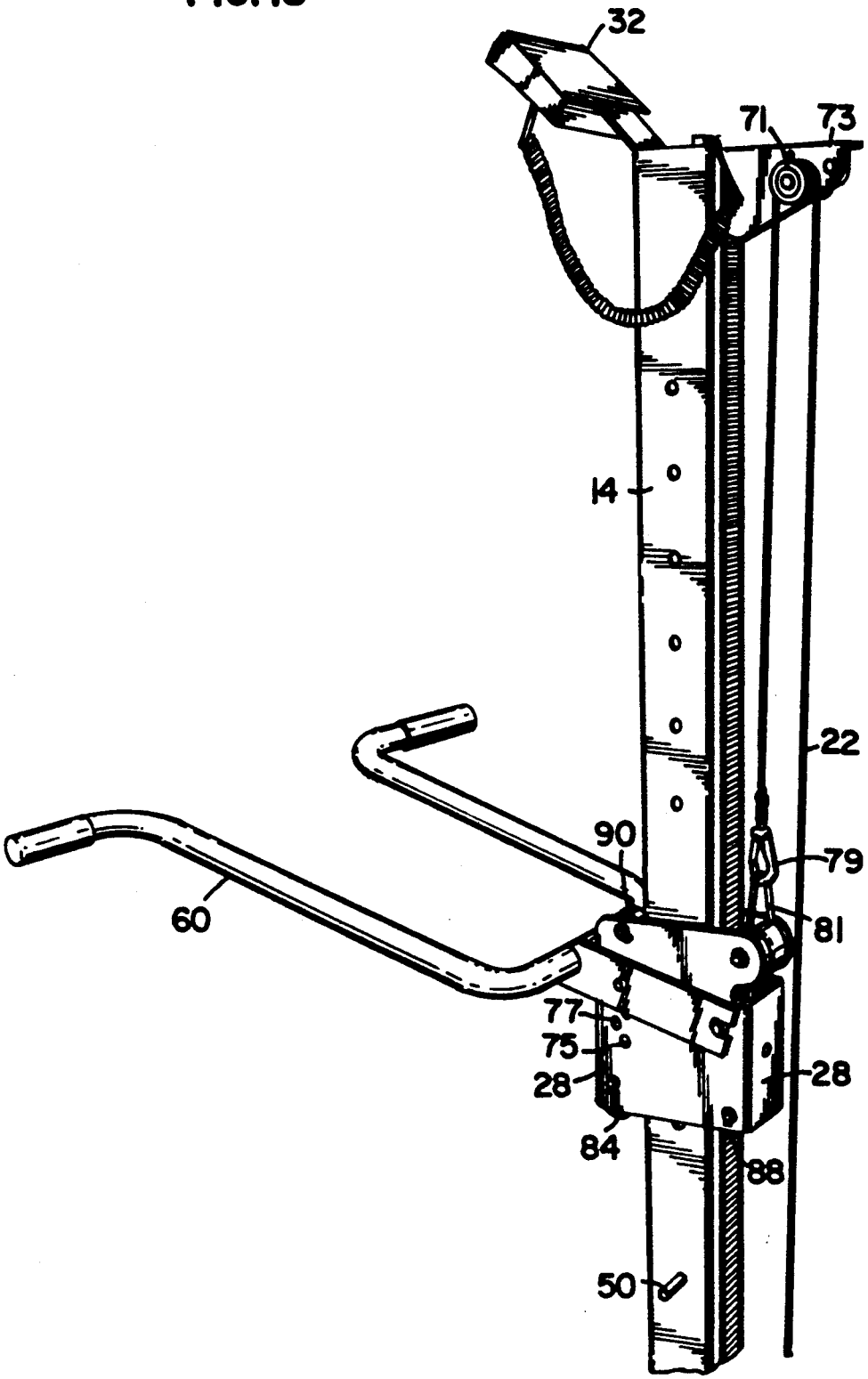
FIG. 18 is a perspective view of a preferred embodiment of a lat pull attachment.

FIG. 18 illustrates a preferred embodiment of a lat pull configuration. Carriage 28 is lifted off the end of vertical member 14, flipped over and put back on vertical member 14 such that roller bearing 84 is positioned where caster 90 was previously positioned, i.e., the closest bearing or caster to bench 16. The carriage 28 is lowered to rest on pin 50. Pulley 71 is positioned atop vertical member 14 with support 73 extending rearwardly and pulley 71 positioned to receive line 22. Line 22 is placed around pulley 71, extended down and attached to carriage 28 via clip 79 to loop 81. Carriage 28 is thereafter suspended from line 22 and pin 50 may be removed. Carriage 28 may then be lifted to a comfortable height for the user sitting on bench 16. Carriage 28 remains in place as a result of cord 62 and resistance device 20. The user then proceeds to pull the carriage 28 down and return carriage 28 to its starting position. This exercise may be repeated over and over to exercise various muscles. Bar 60 may also be tilted in a more compatible position by adjusting pin 50 through apertures 75 and 77. The resistance is adjusted in a manner previously described, i.e. extending line 22 through a series of pulleys. When the user is finished with lat pulls, the carriage 28 is returned to its previous position by lifting carriage 28 over vertical member 14 and reversing the carriage 28 so it may be used for bench presses, etc.

Figure 9:
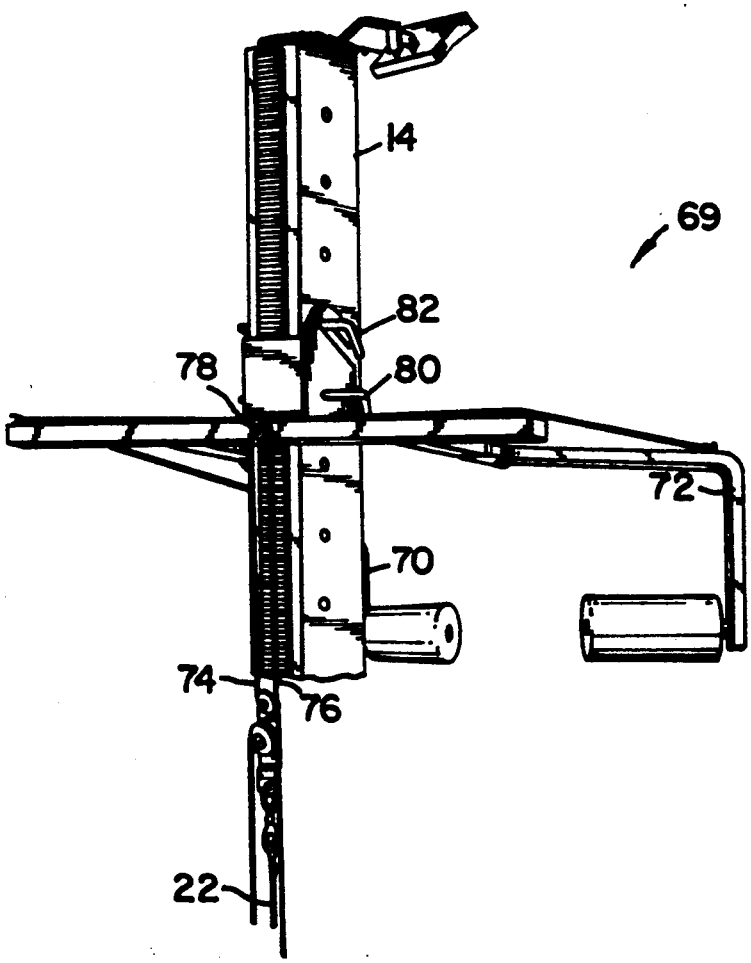
FIG. 9 is a perspective view of a butterfly attachment of the present invention.

FIG. 9 shows a butterfly attachment 69. The user sits on bench 16, grasps the outside of bars 70 and 72 and squeezes bars 70 and 72 together. Line 22, shown at the bottom, is connected to lines 74 and 76, which travel through pulley apparatus 78, and are connected to bars 70 and 72. As bars 70 and 72 are moved together, lines 74 and 76 pull on line 22, thus creating resistance as described previously. Butterfly apparatus 69 is attached to vertical member 14 via pin 80. The pivot axis of the apparatus 69 may be one or more pivot points. Carriage 28 is moved above butterfly apparatus 69 such that it does not interfere with line 22. Pin 82 is inserted in apertures in vertical member 14 wherein carriage 28 resists upon pin 82.

FIG. 10 shows carriage 28 in greater detail. Roller bearing 84 is required in that as line 22 pulls carriage 28 down, as the user pulls the carriage upward, a great deal of torque is applied to carriage 28 and a smooth, loaded bearing is required in order for the carriage 28 to roll freely. Another roller bearing, identical to bearing 82, is hidden from a view in the back with just the securing pin 85 showing. The roller bearings are generally made of solid metal, and thus provide for a smooth movement of carriage 28 as it moves up and down vertical member 14. There is significant force applied at the interface of the roller bearings and vertical member 14 as the carriage 28 moves up and down, thus it is preferred to have some type of bearing race (hardened steel strip or low friction tape) on vertical member 14 as shown as 86. Casters 88 and 90 prevent lateral motion of the carriage as it travels up and down vertical member 14. The wide flange of casters 88 and 90 resist lateral motion of the carriage 28.

Figure 11:
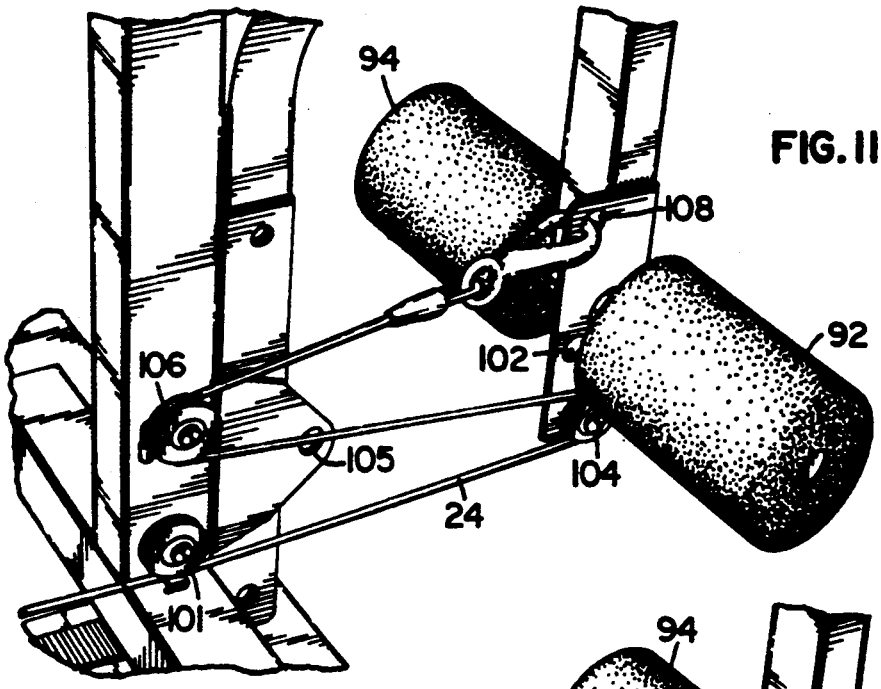
FIGS. 11-13 are perspective views of different resistive settings for the isokinetic device of the present invention.
Figure 12:
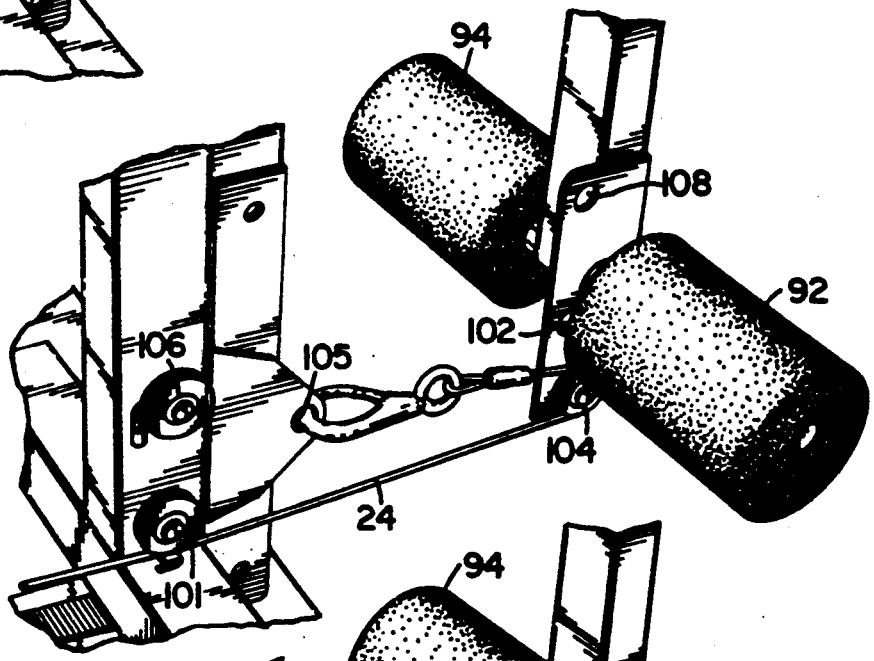
Figure 13:
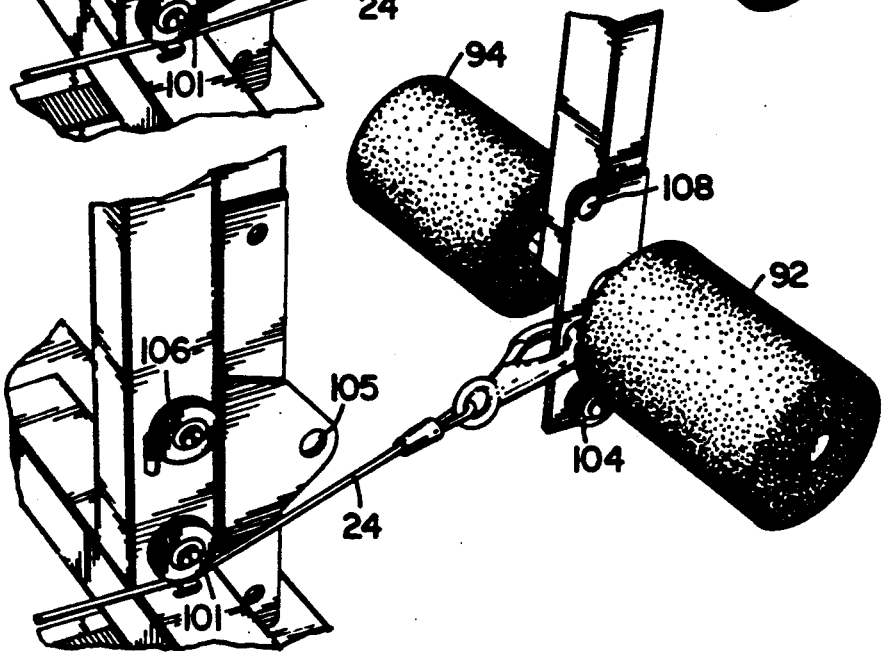

FIGS. 11, 12 and 13 show the various resistance hook-ups for the L-shaped attachment 26. Referring back to FIG. 1, the lower body attachment may be used in a variety of manners. One manner is for an individual to lay flat on his or her stomach on bench 16, and hook the back portion of his or her ankles on pads 92 and 94. The legs are then pulled upward such that the feet are approaching the individual's head (leg flexions), and then the legs are lowered back to the resting position. Another exercise involves the individual sitting on bench 16 facing away from vertical member 14. The front portion of the individual's ankles are hooked under pads 92 and 94 and the user extends his or her legs such that they are in an approximate linear plane with bench 16. Pads 96 and 98 provide cushion for the user's legs during these exercises. Yet another exercise has the user crouch and put his or her elbow on bench 16 while facing away from vertical member 14. The user grabs pad 100, and performs arm curls, thereby moving the L-shaped attachment 26.

An alternative embodiment for the lower body attachment is to not include the L-portion containing pad 100. It is often uncomfortable for certain individuals to lie flat on their stomach (e.g., pregnant women) thus leg flexions are preformed in a standing position. In the alternative embodiment, the user would perform leg flexions standing adjacent the rear portion of bench 16. The user hooks his/her leg between pads 92 or 94 and apparatus 10 and performs leg lifts from a standing position. The exerciser may grasp bench 16 for balance during this exercise. Arm curls may still be performed without the L-portion. The exerciser would place his/her elbow on pads 96 or 98, grasp pad 94 or 92 and perform arm curls. Thus, the alternative lower body embodiment has all of the advantages of the first embodiment.

The resistance for all of these exercises may be adjusted as shown in FIGS. 11–13. FIG. 13 shows the least resisance wherein line 24 is attached to element 26 at aperture 102. As described previously, the amount of resistance is a function of the speed of line movement out of isokinetic device 20. Thus, as line 24 is guided back and forth over more pulleys, the speed of line 24 increases as L-shaped attachment is moved. FIG. 12 represents a middle level of resistance and has line 24 wrapping around pulley 104 and attaching at eyelet 105. The third or highest level of resistance is shown in FIG. 11 wherein line 24 extends around pulleys 104 and 106, and attaches at eyelet 108. Thus, as the L-shaped element 26 is moved about pivot point 27, as shown in FIG. 1, line 24 is pulled out of isokinetic device 20.

Figure 15:
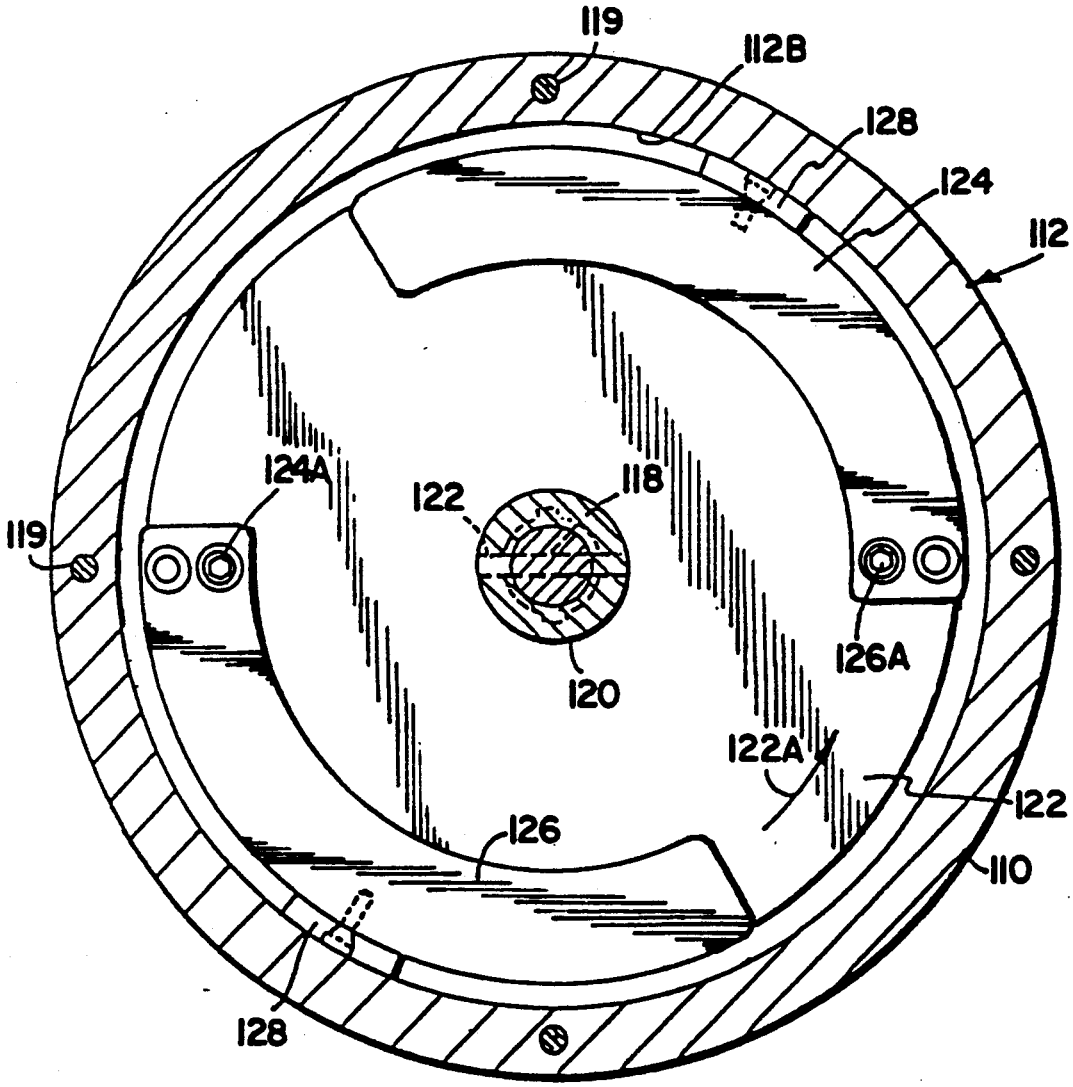
FIG. 15 is a sectional view taken generally on line 8—8 in FIG. 14.
Figure 16:
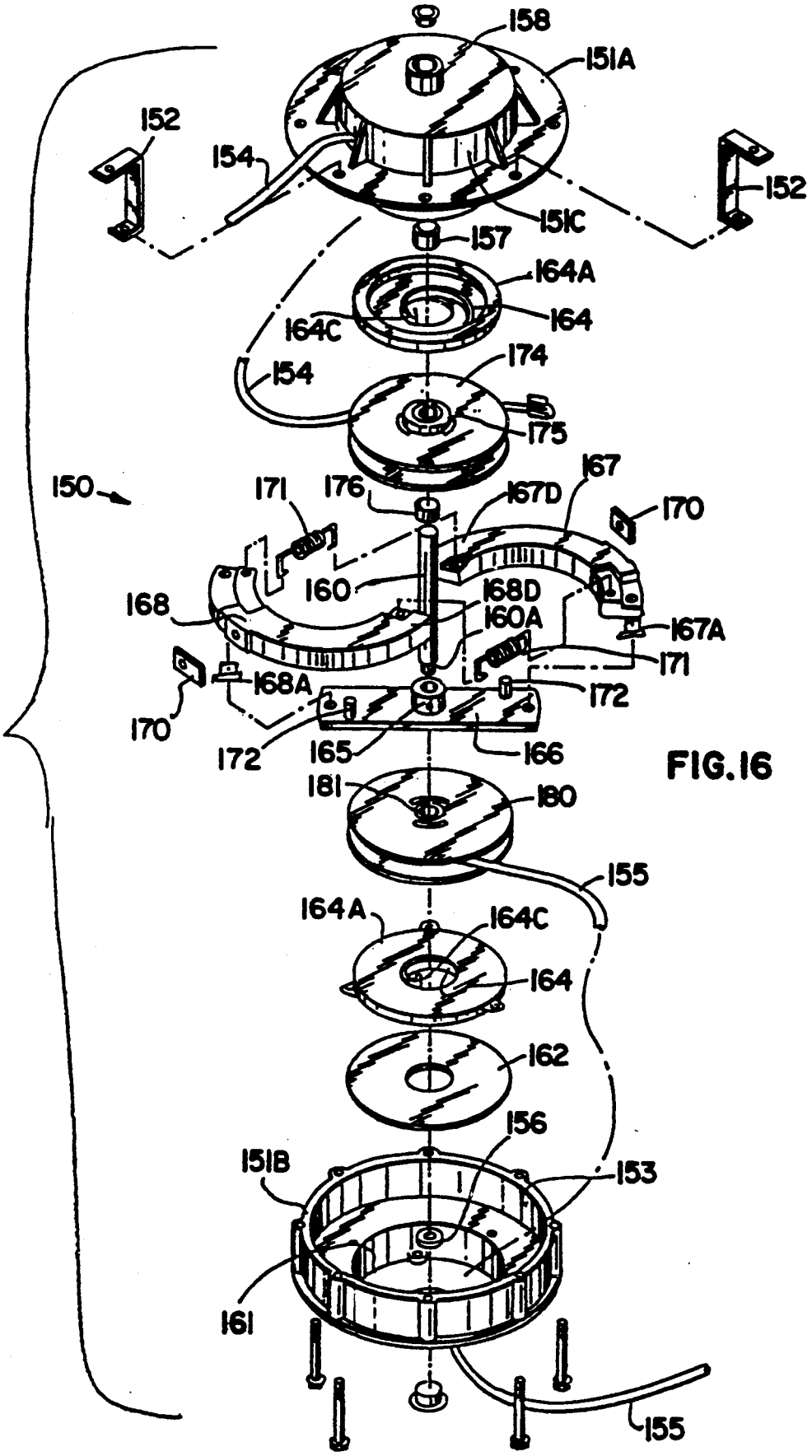
FIG. 16 is an exploded perspective view of an isokinetic device of the present invention.
Figure 17:
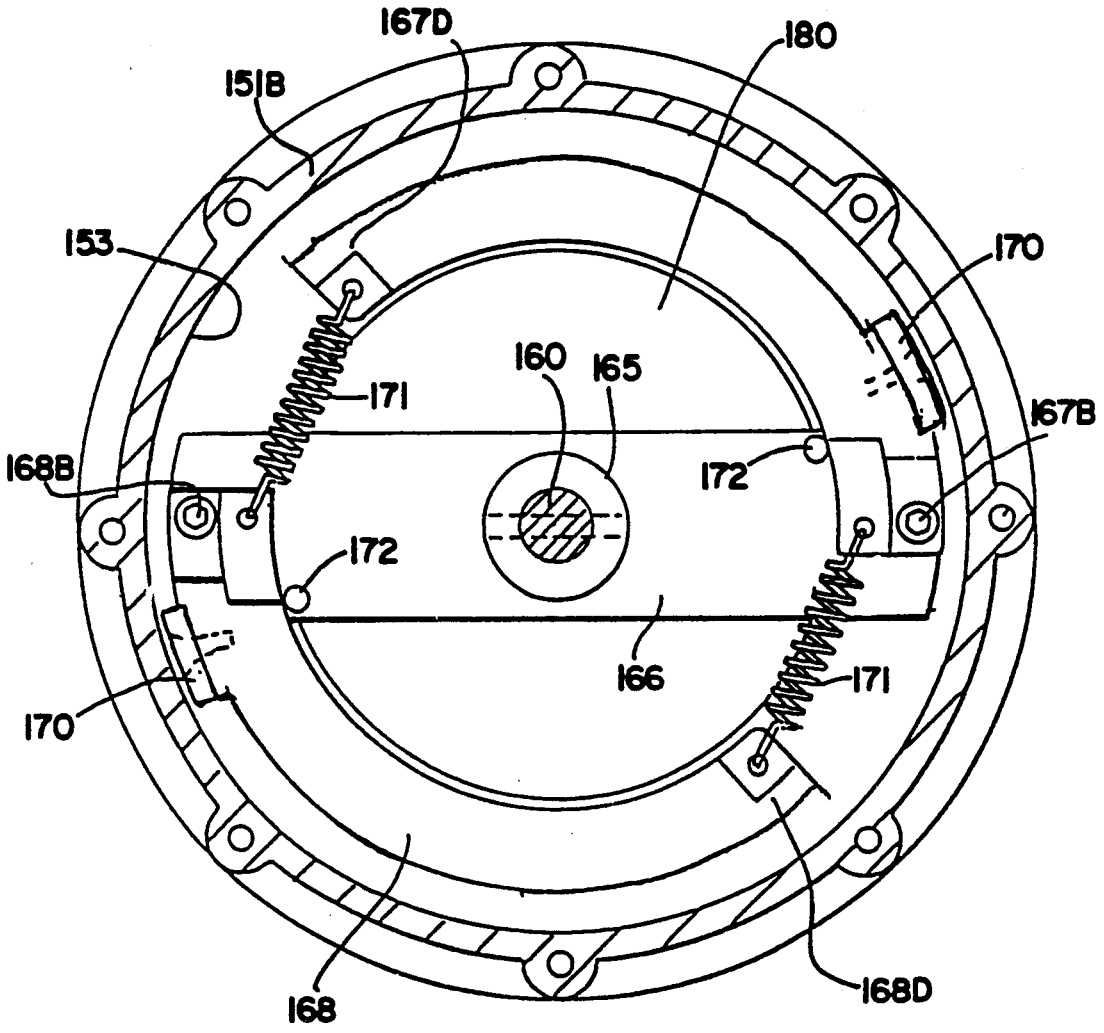
FIG. 17 is a sectional plan view of the isokinetic device shown in FIG. 16.

The isokinetic device or resistance force generating device, which forms an important part of the invention, is illustrated generally in FIG. 1, and is shown in greater detail in FIGS. 15, 16 and 17. The isokinetic device is secured onto horizontal member 12. However, it may also be secured onto the vertical member 14 as well. It is preferred to be on the horizontal member 12. Isokinetic device 20 is secured in place by bolts or rivets so that it is very rigid. The isokinetic device 20 is a centrifugal type device, and is operated by rotating a rotor through pull cords or lines. The rotor is braked to generate loading forces. The pull cords or lines are made so that they will be pulled by the person exercising at differing locations in order to provide loading for the muscles of the user in a desired direction.

An internal central rotor in the isokinetic device 20 is rotated through the use of first and second pull cords or lines 22 and 24, respectively, that exit from the isokinetic device 20 at desired locations. The line 24, as can be seen in FIG. 1 is adjacent a top side of the central rotor housing portion 110, and the line 22 is adjacent the lower side. The lines 22 and 24 are independently operable (extendable and retractable) to provide individual driving of the rotor and thus loading of the cords or lines.

Figure 14:
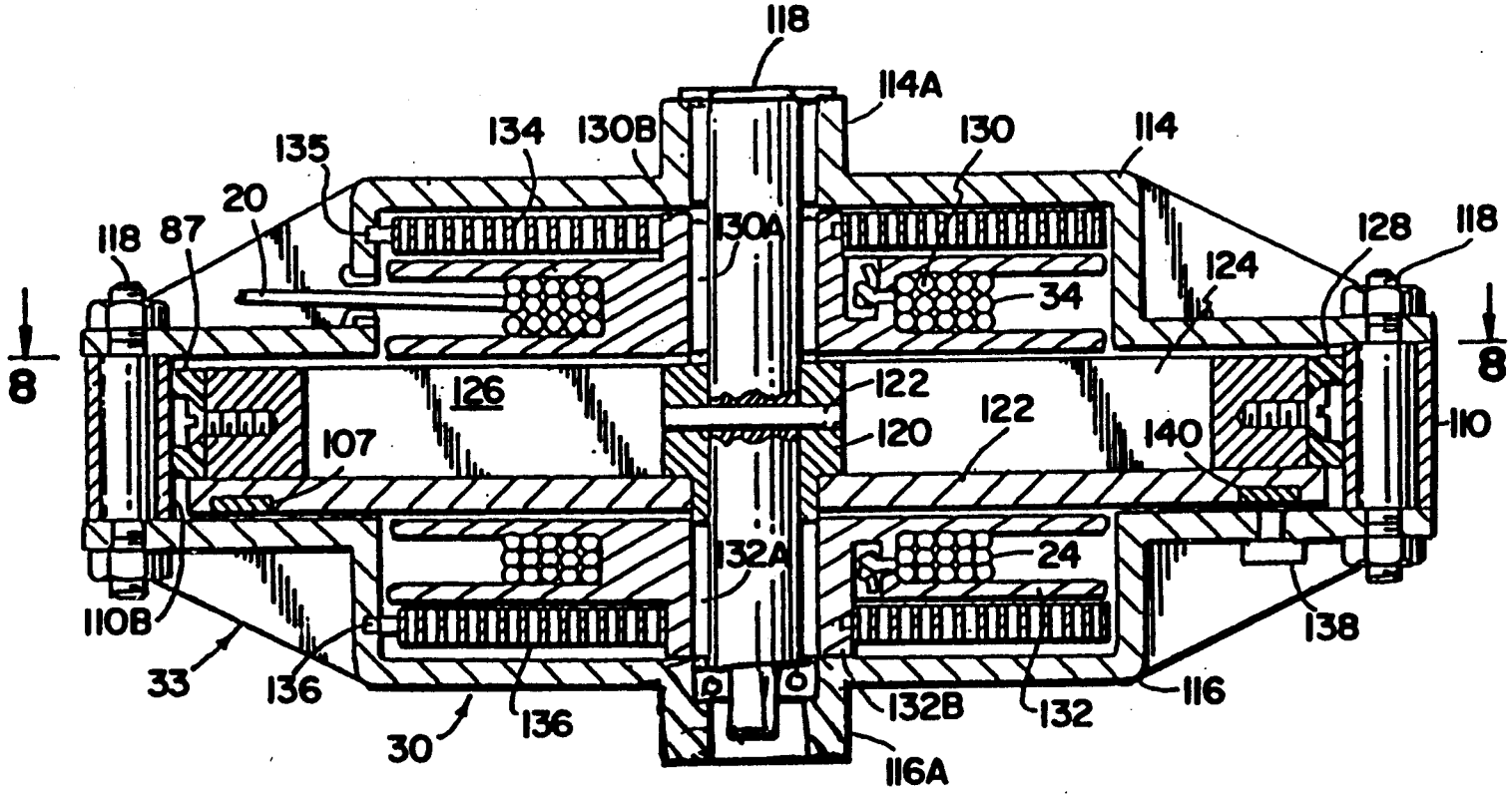
FIG. 14 is an enlarged sectional view of an exercise resistance force loading device of the present invention taken on line 8—8 in FIG. 1.

The isokinetic device 20 is independently operable by the two lines or cords 22 and 24, to drive the movable interior resistance force loading member. As shown in FIGS. 14 and 15, the outer housing 112 has a central annular housing portion 110 that has end caps 114 and 116, respectively, on the top and bottom of center portion 110. One end cap can be cast integrally with the center portion. As shown, there are studs and bolts 119 that hold the top and bottom caps 114 and 116 onto the central housing 110. The end caps 114 and 116 have hubs 114A and 116A that contain suitable low friction bearings for mounting a shaft 118, so that the shaft 118 is rotatably mounted in the two end caps 114 and 116 and is held axially in place. The shaft 118, in turn, drivably mounts a hub 120, which is held with a pin 122 to the shaft 118. The hub 120 is fixed to and carries a rotor disk or plate 122. The rotor 122 thus rotates whenever the shaft 118 is rotated. The rotor 122 is a brake shoe rotor that mounts a pair of pivoted, centrifugally actuated brake shoes 124 and 126, respectively. These brake shoes are pivoted on suitable pivot pins 124 and 126 (FIG. 15) to the brake shoe rotor 122 at diametrically spaced locations positioned adjacent to but within the periphery of the rotor.

The center section 110 of housing 112 forms a brake drum having an interior brake drum surface 112B, and each of the shoes 124 and 126 carries a separate brake friction pad 128 thereon. The friction pad 128 can be a relatively small pad of suitable brake shoe material held in a desired annular location on the brake shoes. The loading action of the brake shoes from inertial forces acting through the brake pads provides an adequate resistance force as the brake shoe rotor 122 is rotated. The brake shoes 124 and 126 are centrifugally actuated flywheel weights that will pivot outwardly under centrifugal force when the brake rotor is rotated. The pivot pins 124 and 126 are selected to be very low friction, to make the action of the brakes satisfactory for operation. The position of the brake pads 128 relative to the pivot pins 124 and 126 is selected to provide resistance force substantially instantly upon movement of the brake shoe rotor disk. The brake pads 128 are close to surface 112B for quick braking action as well.

The lines 22 and 24 are guided into the interior of the respective end caps of the housing 112 through openings in the housing and aligned with a separate top or bottom pulley for the respective lines. A pulley 130 in end cap 114A is shown for receiving the cord 22 wrapped thereon on the top side of the isokinetic device 20, (See FIG. 14). The lines 22 and 24 are anchored on the interior hub of the pulleys 130 and 132, respectively, and then wound onto the respective pulley so that there is an adequate length of cord exterior to desired location for carrying out the exercise desired.

The pulleys 130 and 132 are drivably connected to the shaft 118 through known, quick acting, roller bearing one-way clutches 130A and 132A, respectively, that are mounted on the interior of the hubs of the pulleys. The one-way clutches 130A and 132A thus are made so that they will drive the shaft 118 when the lines 22 or 24 are extended or pulled out. Any extension of either hub will immediately cause the brake shoe rotor disk 122 to start to rotate in direction as indicated by arrow 122A in FIG. 15, and when a certain RPM is reached, causing the brake shoes 124 and 126 to pivot outwardly and cause the friction brake pads 128 to engage the inner surface 110 of the housing or drum 112 and create a resistance force to resist extension of one of the lines 22 and 24 (or both), that is proportional to the force being applied to the respective lines. The speed of rotation of the rotor disk 122 will tend to increase as more force is applied to lines 22 and 24.

The pulleys 130 and 133 are free to rotate relative to shaft 118 in an opposite direction relative to the shaft 118 due to the one-way clutches, to retract the respective lines 22 and 24. Long, flat coiled torsion springs 134 and 136 are used for retraction of long lengths of the lines 22 and 24 without great increase in the retraction force. The springs 134 and 136 are coiled around hub portions 130B and 132B on the pulleys 130 and 132, respectively. One end of each long spring is anchored to the respective hubs 130B and 132B and the other end of each flat spring, at its outer periphery, is anchored as at 135 and 136, respectively, to the wall of the respective end cap 114. The fault springs 134 and 136 are fairly low force, but are also fairly uniform force as the coil changes in size. The torsion springs will wind up (tighter) as the lines 22 and 24 are extended and then when the cords are unloaded or released, the springs 134 and 136 will exert a force to rewind or retract the cords onto their respective pulleys. Thus, repeated cycling can take place with the lines being retracted each time the load on a line is released or reduced sufficiently.

The resistance force generating or loading device is thus speed sensitive, and will provide a greater resistance to extension of the lines as the speed of removal of the lines increases. The speed of removal of the lines will be proportional to the forces exerted on the exercise operable element, and thus if a rapid movement is attempted, a greater force will be exerted by the isokinetic device 20 because of greater centrifugal force on the brake shoes 124 and 126 and thus the greater frictional force between the respective pads 124A and 126A and the inner surface 110B. The amount of force that is used in the exercise can be automatically controlled and compensated. The springs 134 and 136 do not add a significant amount of overall force to extension of the cords.

If desired, a light coil can be used to tend to bias the respective brake shoes 124 and 126 inwardly about their pivot pins 124A and 126A so that there will be no friction load from the brake pads 128 upon slow outward movement of the cords 22 and 24. The resistance load will only be from the retraction springs until the rotor rotates at a sufficient speed. If the pivots 124A and 126A are quite friction free, the resistance load will pick up very rapidly. The display panel of indicators and the like is shown at FIG. 1, and can be any type of display which may be used for displaying speed of rotation of the rotor or sensing and displaying the resistance force generated by the loading device. The display can also be calibrated to display the amount of force being generated. Other displays can be counters for counting the number of times the lines 22 and 24 are cycled, using suitable sensors, such as optical or magnetic sensors. As shown, in FIG. 14, a magnetic type sensor 138 to sense the passage of magnets 140 is embedded in the brake shoe rotator disk at 122. The magnets 140 can be closely spaced around the brake shoe rotor disk 122 to insure detecting rotation almost as soon as the lines 22 and 24 are extended at all. This can provide a speed count, which is proportional to the force being generated. This type of sensor is only one type that can be utilized with the present device and is provided for illustrative purposes only.

In this form of the invention, the isokinetic device 20 indicated at 150 of FIG. 16 and 17 functions in the same manner as that illustrated in the first form of the invention, but includes certain weight reduction and housing improvements. The resistance force generating device 150 has an outer case assembly 151 that is supported through standoff brackets 152 to and below the cross members 133. The cross members 133 are channel shaped for rigidity and lighter weight. Suitable cap screws or bolts are used to securely fasten the case assembly 157 in place. The opposite ends of the standoff brackets 152 are securely mounted with cap screws and bolts to the outer housing 151, using the cap screws or bolts which hold the two parts of the housing together.

In FIGS. 15 and 16, the construction of the resistance force generating device 150 is illustrated in more detail. As stated previously, the resistance force generating device operates in substantially the same manner as in the first form of the invention. The outer housing or casing 151 has an upper housing portion or cap 151A, and a single lower housing section 151B, as shown in FIG. 11. The lower housing portion 151B includes the brake drum center portion integrally cast to the lower cap, and has an inner surface 153 against which the frictional brake pads will operate.

The internal brake shoe rotor of the force generating device 150 is iterated (or rotated) through the first and second pull cords or lines 154 and 155 respectively. The cords or lines 154 and 155 are mounted in upper and lower pulley assemblies, respectively, and are suitably guided over the respective pulley 138 and up through the associated vertical or upright frame member 135. As can be seen, the left frame member 135 will be slightly lower at its lower end to position that associated pulley 138 to align with the exit of the cord 155 from housing 151, for proper guidance. The cord 155 is also shown in FIG. 10.

As shown in FIG. 11, the lower housing portion 151B that includes the internal brake drum having surface 153 will support the cap 151A at the top. Each of the lower housing portion 151B and the top or upper housing portion of cap 151A has a hub that mounts a bearing for a central drive shaft 160. A roller bearing 156 is mounted in the lower housing portion, as shown in FIG. 11, and a needle bearing 157 is mounted in the hub 158 of the upper housing portion of cap 151A. The shaft 160 has a shoulder 160A that rests on bearing 156. In this form of the invention, the lower housing portion has a spring recess or pocket 161, that has an antirattle disk 162 at the bottom surface thereof. A cord retraction spring assembly 163 is mounted in this pocket 161 of the lower housing, as previously shown in the first form of the invention. However, the retraction spring 164 is inside a housing or carriage 164A. The housing 164A is made so that the spring will not fly out, and it is more easily retained if the resistance force generating unit is disassembled. A housing 164A is used in a recess formed by upper housing end portion 151C. The retraction springs are flat springs, as previously explained, and each spring has one end anchored to the respective housing or container 164A. The housings 164 in turn are fixed to the respective outer housing portion 151A or 152B at the end walls of the housing.

The central shaft 160 is drivably mounted to a hub 165 of a brake rotor 166, which comprises a rotor plate or disk. As shown, it is a strap that forms a brake shoe rotor plate which mounts a pair of pivoted, centrifugally actuated brake shoes 167 and 168, respectively. The shoes are pivotally mounted with suitable low friction bushings 167A and 168A, respectively, and then the bushings are in turn held in place with suitable pins or bolts 167B and 168B back to the brake disk rotor 166.

The hub 165 is drivably coupled to the shaft with suitable set screws in the hub, that act against the shaft.

The shaft can have other types of retainers, if desired. In the resistance force generating device, the brake shoes 167 and 168 are aligned with the brake drum surface 153, and have brake pads 170, 170 mounted in suitable portions of the brake shoes adjacent to the pivot pins. The brake shoes in turn are also urged inwardly with light tension springs 171, 171 that act to hold the outer or free ends shown at 168D and 167D of the brake shoes inwardly. This will prevent brake force from initially being present when the rotor is rotated at a slow speed, and the retraction springs that were shown at 164 will provide a load as the cords are extended. The brake rotor has stop pins 172 that limit the inward pivoting of the brake shoes.

The cord 154 is mounted and wound on an upper cord pulley assembly 174, and it is guided through a suitable opening in the upper housing section 151A to align with the pulley when it is in position on the shaft 160. The pulley 174 has a central hub 175 in which a suitable one-way clutch shown at 176 on the interior of the hub 175 is mounted. This one-way clutch is drivably mounted in the hub 175, and will cause the pulley 174 to drive the shaft 160 when the cord 154 is extended from the housing 151, but will permit freewheeling of the pulley 174 relative to the shaft 160 in the opposite direction of rotation.

The pulley hub 175 also has an attachment device for attaching the free end 164B (inner end) of the associate spring 164, so that when the pulley 174 is rotated, the flat, coiled spring 164 will be tightened to provide a retraction spring force on the pulley 174. When the cord 154 is not under load from exercising, the pulley 174 will be rotated by the spring force and freewheel relative to the shaft 160 to retract the cord.

Line 155 is mounted onto a cord pulley 180 which provides for adequate cord storage when the cord is would thereon between side flanges. The pulley 180 also has a hub with a central bore in which a one-way clutch 181 is mounted. The pulley has a lower hub end that is identical to the hub end 175, but which is not shown in FIG. 11, that is used for connecting to the inner end 164C of the associated spring 164, so that when the cord 155 is extended, the one-way clutch in the bore 181 will drive the shaft 160, in the same direction of rotation as the driving force on the cord 154, causing the shaft 160 to rotate and, of course, the brake rotor 166 to also rotate so that when a certain speed is exceeded, the brake shoes 167 and 168 will move outwardly under centrifugal force and cause the brake shoe pads 170 to engage the surface 153 and provide a resistance force.

The restriction spring 164 that is associated with the pulley 180 will be tightened as the cord 155 is extended. The cord 155 extends through a suitable aperture in the lower housing section 1512B, as shown in the previous form of the invention. When the cord 155 is released, after being extended during exercise, the retraction spring 164 for the pulley 180 will rotate the pulley to retract the line or cord 155 and the one-way clutch in the bore 181 will permit this retraction without driving or dragging on the shaft 160. The inner ends of the cords 154 and 155 are suitably attached to the inner hubs of the pulleys 174 and 180, respectively, in a known manner between the side flanges of the pulleys. Likewise, the outer ends of the springs 164, as stated are anchored to the housings 163, which, in turn, were anchored to the housing sections 151A and 151B.

The resistance force generating device 150 is speed sensitive, and the more rapidly the cords 154 and 155 are extended, as previously explained, the greater the resistance force that will be generated.

Thus, isokinetic exercises are easy to perform because the resistance force of the isokinetic device 20 will increase to match the force applied through the cords or lines 20 and 24 or 154 and 155. No large weights are lifted to provide resistance, nor are there any weights which can fall or cause a muscle strain. The resistance stops as soon as the applied force to the cords or lines is removed.

The electronic panel on the readout can be LED readouts, to digitally show the pounds of pull and also be set to provide a signal when a desired load is reached. The sensor 138 can provide a count of the number of repetitions to ensure that a complete exercise program is being followed.

The term "line" includes wire cables, cords, ropes and other equivalent elongated flexible members.

Although the present invention has been described with reference to preferred embodiments, workers skilled in the art will recognize that changes may be made in form and entail without departing from the spirit and scope of the invention.

What is claimed is:

1. An exercise apparatus comprising:

(a) a positionable bench;

(b) a horizontal member extending below said bench;

(c) a vertical member extending upwardly from a first end of said horizontal member;

(d) a loading device operable to apply a drag on a moveable element forming part of the loading device, said loading device situated on said horizontal or vertical member, said loading device comprising a rotatable centrifugal force sensitive force generating brake member that provides a resistive force proportional to the speed of rotation of the rotatable member, said loading device comprising a housing having sidewalls that define an interior cylindrical contact surface and function as a brake drum, a braking rotor rotatably mounted within said housing and coaxially aligned relative to said interior cylindrical contact surface, at least one brake shoe pivotally mounted on said braking rotor, at least one brake pad secured to said at least one brake shoe and having an exterior cylindrical contact surface configured to mate with said interior cylindrical contact surface;

(e) an exercise operable element connected to said loading device by a flexible line means, said exercise operable element being mounted such that upon movement of said exercise element, said line means is pulled away from said loading device, said moveable element of said loading device is moved and said line means is loaded; and (f) a line extending means outside said loading device for multiplying the rate at which said line means is pulled away from said loading device, wherein said line means extends through said line extending means.

2. The exercise apparatus of claim 1 wherein said exercise operable element is configured so it is suitable for grasping and displacing in a vertical direction, said exercise element extending over said bench and comprising a slidable carriage, said carriage having said line means secured thereto, said carriage configured such that it slides in an essentially vertical plane on said vertical member.

3. The exercise apparatus of claim 2 wherein said resistance force is adjusted by extending the length of said line means outside of said loading device through at least one pulley located on said carriage.

4. The exercise apparatus of claim 3 having a second pulley positioned closer to said horizontal member, a third pulley positioned in proximity to said first pulley, all pulleys being of size to guide said line means, whereby said line means is guidable out of said loading device around said first pulley, back toward said horizontal member, and then guided by said second pulley upwardly to said third pulley such that said line means may be guided around said third pulley and thereafter said line means secured to a pin means on said carriage.

5. The exercise apparatus of claim 2 wherein said carriage has at least two roller bearings and at least two caster wheels, said bearings and wheels suitable for operational movement of said carriage on said vertical member.

6. The exercise apparatus of claim 2 wherein said exercise element has a pulley positioned adjacent a top portion of said vertical member and a mounted in a manner such that said carriage is supported by said line means, said line means extending over said pulley and attaching to said carriage, said carriage providing resistance when pulled in a downward manner.

7. The exercise apparatus of claim 6 wherein said resistance may be increased by extending said line means through additional pulleys.

8. The exercise apparatus of claim 1 wherein said exercise element comprises a butterfly configuration, said butterfly configuration being secured to said vertical member and comprising two arms extending in a horizontal plane away from said vertical member, said arms moveable in an arcuate manner about at least one pivot point.

9. The exercise apparatus of claim 8 wherein said resistance force is adjusted by extending the length of said line means through at least one pulley located on said butterfly configuration.

10. The exercise apparatus of claim 1 wherein said line means is wound around a loading pulley on the loading device, said loading pulley being drivably connected to the rotatable force generating member through a one-way clutch means.

11. The exercise apparatus of claim 1 wherein said exercise element comprises a bar configured so as to provide resistance force about an axis perpendicular to said bench, said exercise element positioned at a second end of said horizontal member.

12. The exercise apparatus of claim 11 wherein said exercise element is an L-shaped configuration with a middle portion of said L-shaped configuration being pivotably attached to a vertically extending member of said horizontal member.

13. The exercise apparatus of claim 12 wherein the resistive force of said exercise element is adjusted by extending the length of said line means through at least one pulley.

14. The exercise apparatus of claim 1 having an electronic display readout which displays at least one output selected from the group consisting of repetitions, measured force, maximum force or average force.

15. An exercise apparatus comprising:

(a) a positionable bench;

(b) a horizontal member extending below said bench;

(c) a vertical member extending upwardly from a first end of said horizontal member;

(d) a loading device operable to apply a drag on a moveable element forming part of the loading device, said loading device situated on said horizontal or vertical member, said loading device comprising a rotatable centrifugal force sensitive force generating brake member that provides a resistive force proportional to the speed of rotation of the rotatable member, said loading comprising a housing having sidewalls that define an interior cylindrical contact surface and function as a brake drum, a braking rotor rotatably mounted within said housing and coaxially aligned relative to said interior cylindrical contact surface, at least one brake shoe pivotally mounted on said braking rotor, at least one brake pad secured to said at least one brake shoe and having an exterior cylindrical contact surface configured to mate with said interior cylindrical contact surface;

(e) an exercise operable element configured so it is suitable for grasping and displacing in a vertical direction, said exercise element extending over said bench and comprising a slidable carriage, said carriage having said line means secured thereto, said carriage configured such that it slides in an essentially vertical plane on said vertical member (f) a line extending means outside said loading device for multiplying the rate at which said line means is pulled away from said loading device, wherein said line means extends through said line extending means; and (g) an exercise operable element having an L-shaped configuration with a middle portion of said L-shaped configuration being pivotably attached to a vertically extending member attached to a second end of said horizontal member.

16. The exercise apparatus of claim 15, wherein said resistance force is adjusted by extending the length of said line means outside of said loading device through at least one pulley located on said carriage.

17. The exercise apparatus of claim 16 having a second pulley positioned closer to said horizontal member, a third pulley positioned in proximity to said first pulley, all pulleys being of size to guide said line means, whereby the line means is guidable out of the loading device around the first pulley, back toward the horizontal member, and then guided by the second pulley upwardly to said third pulley such that said line means may be guided around said third pulley and thereafter said line means secured to a pin on said carriage.

18. The exercise apparatus of claim 15 wherein said carriage has at least two roller bearings and at least two caster wheels, said bearings and wheels suitable for operational movement of said carriage on said vertical member.

19. The exercise apparatus of claim 15 wherein said exercise element has a pulley positioned adjacent a top portion of said vertical member and is mounted in a manner such that said carriage is supported by said line means, said line means extending over said pulley and attaching to said carriage, said carriage providing resistance when pulled in a downward manner.

20. The exercise apparatus of claim 15, wherein said resistance may be increased by extending said line means through additional pulleys.

21. The exercise apparatus of claim 15 having an electronic display readout which displays at least one output selected from the group consisting of repetitions, measured force, maximum force or average force.

* * * * *